US005350025A

United States Patent [19]

Campbell et al.

[11] Patent Number: 5,350,025

[45] Date of Patent: Sep. 27, 1994

[54] NONROTARY PISTON FOR JACKHAMMER AND REMOVABLE SPLINED NUT THEREFOR

[75] Inventors: Paul B. Campbell, Roanoke; Robert R. Kimberlin, Troutville; Sean M. O'Malley; Roland P. Holt, both of Roanoke, all of Va.

[73] Assignee: Ingersoll-Rand Company, Woodcliff Lake, N.J.

[21] Appl. No.: 135,222

[22] Filed: Oct. 12, 1993

Related U.S. Application Data

[62] Division of Ser. No. 948,545, Sep. 23, 1992, Pat. No. 5,305,835.

[51] Int. Cl.[5] ..... B25D 9/04; B25D 16/00

[52] U.S. Cl. ..... 173/111; 173/97; 173/133

[58] Field of Search ..... 173/111, 104, 128, 133, 173/206, 109, 110, 97, 78

[56] References Cited

U.S. PATENT DOCUMENTS

| | | | |
|---|---|---|---|
| 771,218 | 9/1904 | Gilman | 173/111 |
| 1,084,270 | 1/1914 | Hansen | 173/111 |
| 1,293,960 | 2/1919 | Smith | 173/111 |
| 1,375,444 | 4/1921 | Bayles . | |
| 1,740,684 | 12/1929 | Gartin | 173/111 |
| 1,773,366 | 8/1930 | Lear . | |
| 2,195,204 | 3/1940 | Gartin . | |
| 2,251,224 | 7/1941 | Curtis . | |
| 2,326,383 | 8/1943 | Morrison . | |
| 2,514,852 | 7/1950 | Feucht et al. . | |
| 2,755,069 | 7/1956 | Mosby . | |
| 2,821,963 | 2/1958 | Curtis . | |
| 3,055,441 | 9/1962 | Morrison . | |
| 3,074,381 | 1/1963 | Osgood . | |
| 3,171,510 | 3/1965 | Lear . | |
| 3,404,739 | 10/1968 | Worman . | |
| 3,865,198 | 2/1975 | Price . | |
| 3,972,376 | 8/1976 | Price . | |
| 4,131,165 | 12/1978 | Wanner et al. . | |
| 4,319,646 | 3/1982 | Emonet | 173/111 |
| 4,442,759 | 4/1984 | Elser . | |
| 4,491,445 | 1/1985 | Hunger et al. . | |
| 4,508,015 | 4/1985 | Lin . | |
| 4,690,226 | 9/1987 | Schnizler et al. . | |
| 4,896,584 | 1/1990 | Stoll et al. . | |
| 5,139,093 | 8/1992 | Lyon et al. | 173/111 |

FOREIGN PATENT DOCUMENTS 2519251 11/1976 Fed. Rep. of Germany .

*Primary Examiner*—Scott A. Smith
*Attorney, Agent, or Firm*—John J. Selko

[57] ABSTRACT

A fluid-activated, percussive impact tool has a piston therein that reciprocates longitudinally but not rotationally. The piston activates a wrap spring clutch to rotate the drill steel. A removable splined nut in combination with the tool's housing restrains rotation of the piston, while permitting longitudinal reciprocation of the piston.

4 Claims, 3 Drawing Sheets

NONROTARY PISTON FOR JACKHAMMER AND REMOVABLE SPLINED NUT THEREFOR

This is a divisional application of pending prior U.S. patent application Ser. No. 07/948,545 filed on Sept. 23, 1992 for Nonrotary Piston For Jackhammer And Removable Splined Nut Therefor now U.S. Pat. No. 5,305,835.

BACKGROUND OF THE INVENTION

This invention relates generally to a fluid activated percussive impact tool having a piston reciprocal in a housing of such tool, and more particularly to a jackhammer in which the piston is longitudinally reciprocal and the drill steel is rotated as well as impacted by the piston.

Typical jackhammer construction uses a piston which is reciprocated by a fluid cycle to provide percussive energy to a drilling steel. Proper operation of the drill requires that the drill steel rotate as the piston reciprocates. This rotary motion is accomplished through a series of splines and a clutching mechanism. The spline geometry is normally such that the piston is required to rotate with the drill steel. A typical drill will operate on a two inch stroke at 2000 blows per minute which is approximately 670 ft/min surface feet in the axial direction. The drill typically rotates at 140–150 rpm. An average piston diameter is 2 inch which results in a rotary surface footage of approximately 75 ft/min. Both components of surface footage contribute to the total wear of the piston geometry to its surrounding components. Elimination of the rotary component of surface footage would reduce the wear between these components. Consequently, performance and part integrity should increase as the drill is operated.

For rotating the drill steel, a typical configuration uses a splined nut in a jackhammer. The splined nut has threaded outside diameter with an internal spline type of geometry. The threaded area is usually grounded to another component within the drill such as a chuck or chuck driver. The internal splines on the nut engage with splines on the piston. The torsional interaction between the splines of the piston and nut often results in high wear of the nut itself. Repair of the assembly is difficult and requires special wrenches to disassemble the nut from the piston or chuck geometry.

The foregoing illustrates limitations known to exist in present jackhammers. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a fluid activated percussive impact tool having a reciprocal piston with a piston stem, a piston tail and a piston head; a plurality of longitudinal and helical grooves along the piston stem; an interference fit nut removably positioned between the tool housing and the longitudinal grooves to permit longitudinal movement, but not rotation of the piston.

In a second aspect this is provided by a removable splined nut combination that has a plurality of splines in an inner surface of the nut, which splines are slidably positioned in longitudinal grooves in a piston stem, to permit longitudinal reciprocation of the piston. The nut has a plurality of lobes on an external surface of the nut, which lobes form an interference fit with a plurality of matching lobe cavities in an adjacent housing, for restraining rotation of the piston. A wrap spring clutch provides rotational movement to a drill steel, during longitudinal reciprocation of the piston.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

While this invention has been illustrated and described in accordance with a preferred embodiment, it is recognized that other variations and changes may be made therein without departing from the invention as set forth in the claims.

Figure 1:
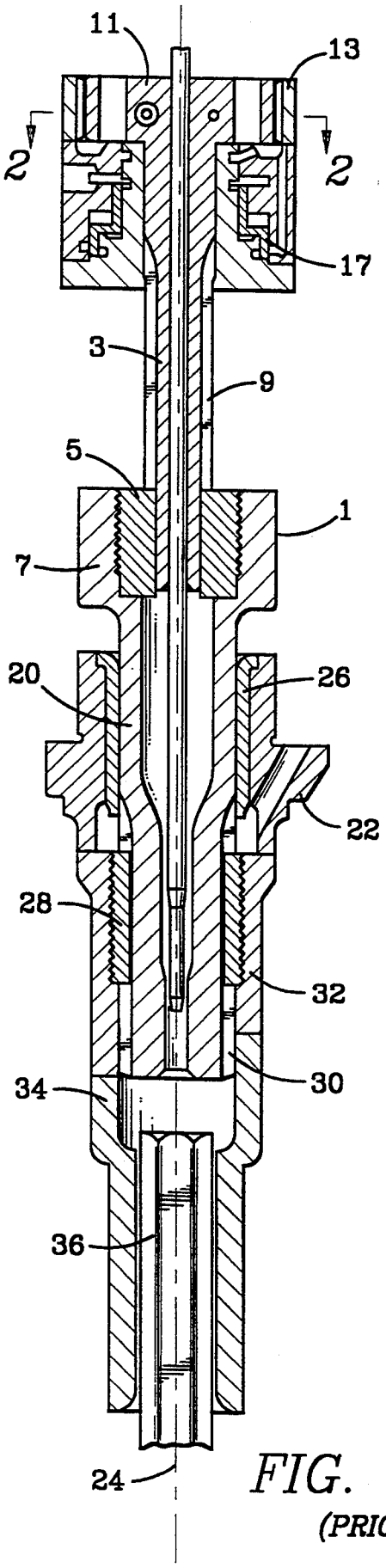
FIG. 1 (PRIOR ART)
FIG. 1 is cross sectional view, with parts removed, of a prior art piston rotated by a ratchet and pawl mechanism.
Figure 2:
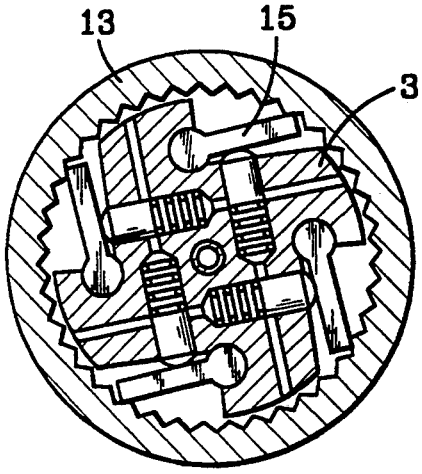
FIG. 2 (PRIOR ART)
FIG. 2 is a view along lines A—A of FIG. 1.

Referring to FIG. 1 and 2, the prior art jackhammer having a mechanism for rotating the piston during the stroke cycle is shown. Piston 1 is mounted on rifle bar 3 by means of piston rifle nut 5 that is threadably connected to piston head 7. Piston rifle nut 5 is slidably mounted on rifle bar 3 by means of internal splines that match longitudinal grooves 9 that extend along rifle bar 3 in the same longitudinal direction as the reciprocation of piston 1.

Top end 11 of rifle bar 3 is connected to a ring gear 13 by means of a plurality of pawls 15 that interact with ring gear 13 to permit rotation in only one direction. Ring gear 13 is positioned in the backhead portion of the jackhammer housing (not shown) along with valve 17 that distributes percussive fluid to the drill during the operation thereof.

Piston stem 20 is supported in housing 22 for reciprocation along longitudinal axis 24 by piston stem bearing 26. Chuck nut 28 is slidably mounted on piston stem 20 by means of internal splines that match longitudinal grooves 30 that extend along piston stem 20. Chuck nut 28 is threaded into chuck driver 32, that is, in turn, connected to chuck 34. Drill steel 36 is slidably mounted into chuck 34. Thus, it can be understood, that in the prior art jackhammers, the piston 1 reciprocates back and forth in a longitudinal direction, while at the same time, it rotates in one direction. This rotational movement is translated to drill steel 36 by means of the connection between piston 1 and piston rifle nut 5, and splined chuck nut 28 that is, in turn, connected to chuck driver 32, and chuck 34.

Figure 3:
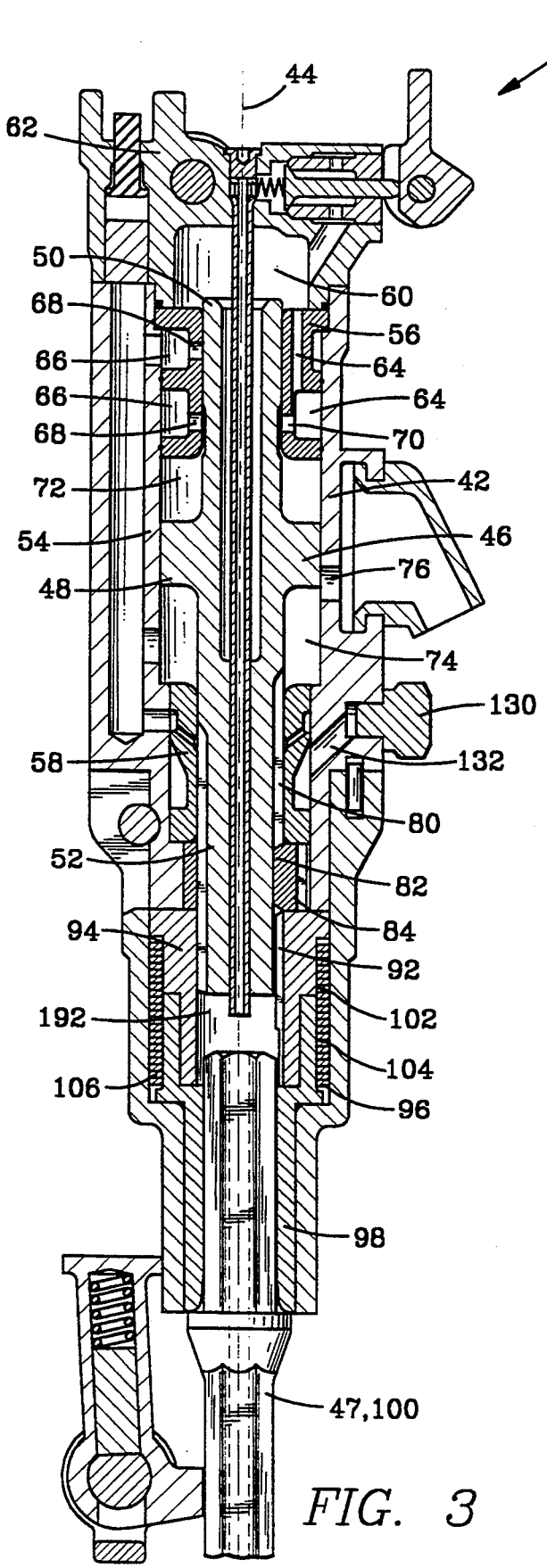
FIG. 3 is a cross sectional view of the jackhammer of this invention.

Referring to FIG. 3, the jackhammer of the invention is shown generally as 40 having an outer housing 42 through which extends a central bore having a longitudinal axis 44 for reciprocation of a piston 46 and a drill steel 48, 100, as is conventional. Piston 46 is actuated by a percussive fluid, such as compressed air at a pressure of about 90 to 100 psig. Piston 46 comprises a piston head 48, a piston tail 50 on one side of piston head 48, and a piston stem 52 on an opposite side of piston head 48. Piston 46 is supported for longitudinal reciprocation in housing 42 by housing body member 54 contacting piston head 48, air distributor 56 contacting piston tail 50 and piston stem bearing 58 contacting piston stem 52, as is well known.

Percussive fluid is introduced into accumulator chamber 60 in backhead 62, and is directed by distributor 56 to fluid passageways 64, 66 and ports 68, 70 to a drive chamber 72 and thereafter to a return chamber 74. Depending upon the position of piston 46 in the stroke cycle, either drive chamber 72 or return chamber 74 is opened to exhaust port 76, to exhaust the fluid in the respective chamber, 72 or 74.

Figure 5:
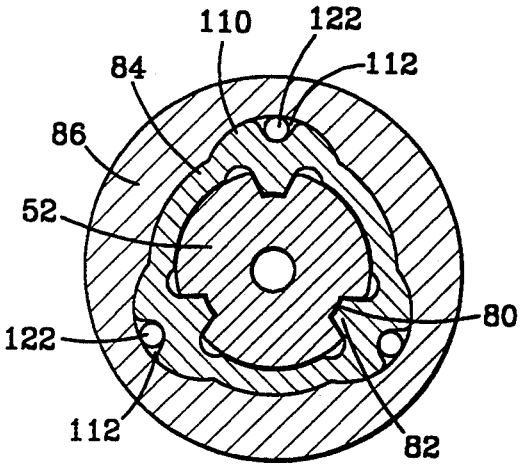
FIG. 5 is view along lines B—B of FIG. 4.

The piston 46 is grounded from rotary motion through a series of longitudinal grooves 80 that extend downwardly along piston stem 52. As used herein, the terms "longitudinal" or "longitudinally" mean in a direction that is parallel to axis 44. Grooves 80 mate to splines 82 in a removable splined nut 84 that is non-rotatable, with respect to its surrounding housing 86 (FIG. 5). Splines 82 are formed in an inner surface of nut 84 and extend longitudinally downwardly along the length of nut 84.

Figure 8:
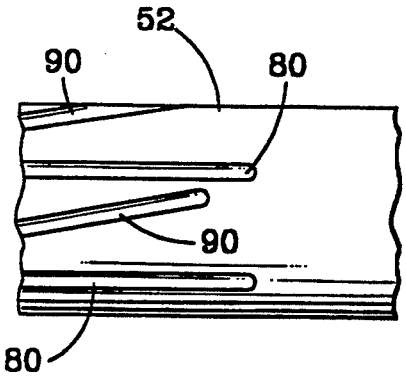
FIG. 8 is perspective view of a piston stem showing the longitudinal and helical grooves.

The piston 46 also has a series of helical grooves 90 (FIG. 8) which are connected to helical splines 92 in a helical nut 94. Helical grooves 90 extend downwardly along piston stem 52 and are located between a said longitudinal grooves 80, preferably one helical groove 90 between each pair of adjacent longitudinal grooves 80. The helical action of the splines 82 causes the helical nut 94 to oscillate rotatably back and forth as the piston 46 reciprocates. The helical nut 94 is then frictionally attached to a unidirectional clutch mechanism, such as a wrap spring clutch 96, which drives the chuck 98 and drill steel 100. Helical nut 94 is provided with an external surface that has a first hub surface 102 thereon. Chuck 98 is positioned in the bore so that a second external hub surface 104 on chuck 98 is provided adjacent to first hub surface 102. A helical spring 106 is wrapped around both first and second hub surfaces 102, 104, so that as piston 46 reciprocates, the chuck 98 and drill steel 48, 100 therein, rotate in one direction. The wrap spring clutch mechanism is described in U.S. Pat. No. 5,139,093, issued to Leland H. Lyon et al.

Splined nut 84 is removable from housing 86. Removability is provided by eliminating the prior art threaded connection between nut 5 and piston head 7, that is shown in FIG. 1, and providing the nut 84 with internal splines 82 that engage with mating grooves 80 in piston stem 52, as shown in FIG. 3. Thus, it can be understood that nut 84 is slidably splined on piston stem 52, but is non-rotatable with respect to the longitudinal axis 44, piston 46 and housing 86.

As shown in FIG. 5, the nut 74 has at least one lobe 110 on the outside profile of the nut itself. While I prefer three lobes 110, equally spaced around a circumference of an outer surface of nut 84, any reasonable number will work. Each lobe 110 of this male profile of the nut 84 engages a female type lobe cavity 112 in the surrounding housing 86. The piston 46 reciprocates as the drill operates. The wrap spring clutch 96 influences the piston 46 to rotate. The function of the nut 84 is to prevent this rotation. As the piston 46 tries to rotate, the splines 82 of the nut 84 resist the rotation. The torsional load is then transmitted to the lobes 110 and lobe cavities 112 of housing 86, thus preventing rotation.

Figure 6:
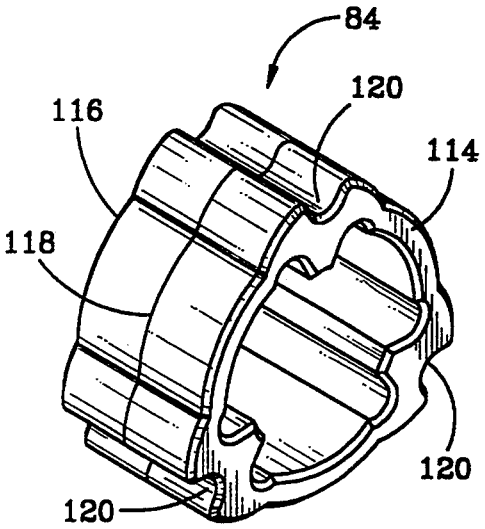
FIG. 6 is an isometric view of a removable splined nut for use in this invention.
Figure 7:
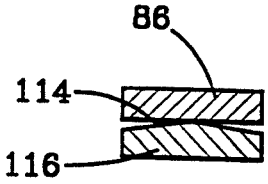
FIG. 7 is an expanded view in circle A of FIG. 4.

As shown in FIGS. 6 and 7, tapering of the outside diameters of the nut 84 further assists in the ability of the nut 84 to carry the load. The nut 84 is tapered such that, when viewed in a cross sectional view, the entire male profile is smaller at the top end 114 and bottom end 116 of nut 84 than at the center portion apex 118 between the top and bottom ends 114, 116, respectively, of the nut. As the nut 84 is inserted into the female housing profile, the nut 84 pinches the housing 86. Thus, it can be understood that there are provided two interference fits: the first one by the lobes 110 and a second one by the tapered body of the nut.

In addition, a third interference fit can be provided by forming in one or more lobes 110 a longitudinal groove 120 extending axially lengthwise along the length of nut body 84. I prefer to provide a groove 120 in each of the three lobes 110. A pin 122 is mildly pressed into each groove 120 for a force fit between the nut 84 and the lobe cavity 112 of housing 86. As the other two interfaces wear away, the pin arrangement will act similar to a roller ramp type clutch which would further pinch the geometry as the nut begins to rotate.

Figure 4:
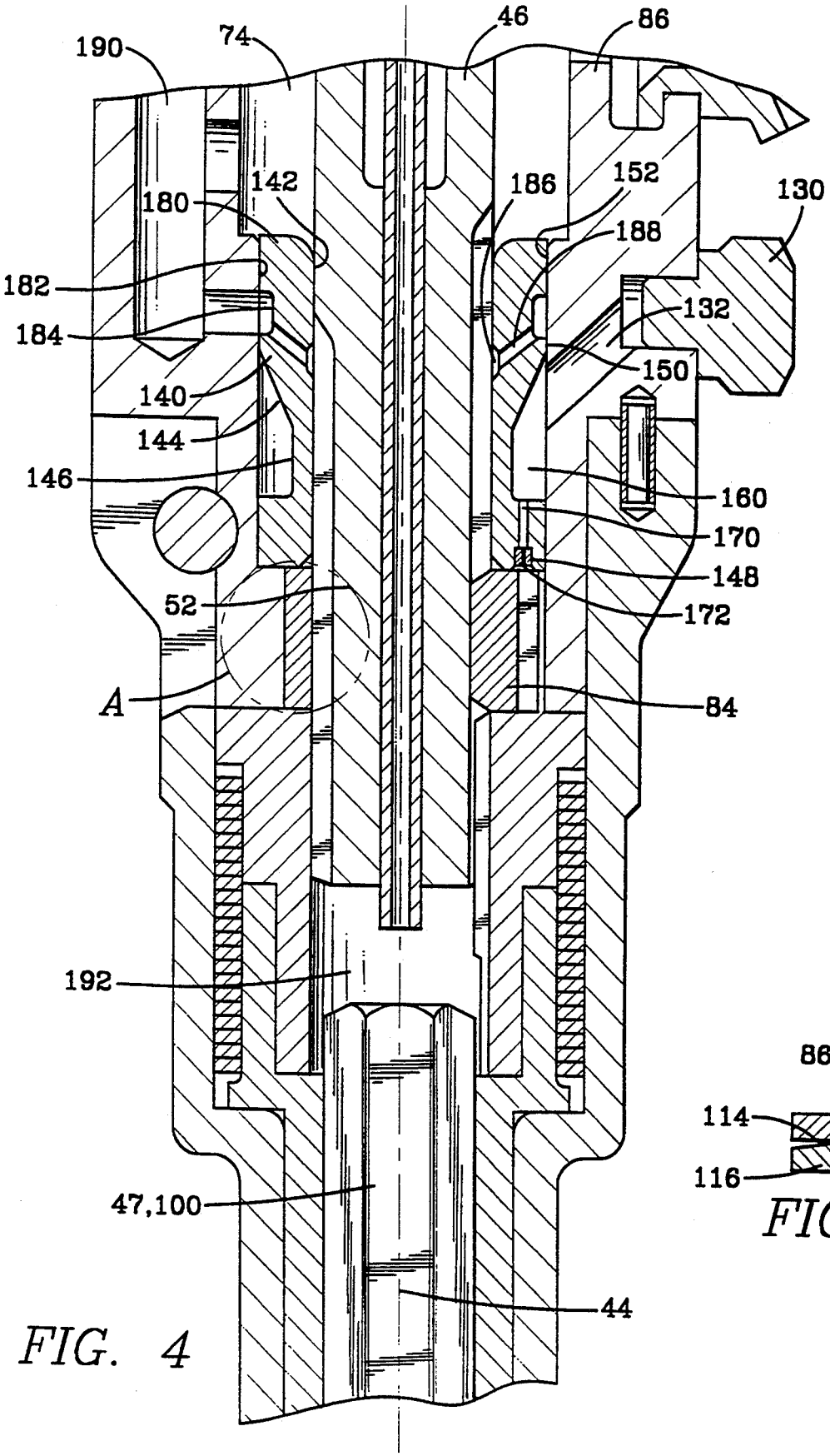
FIG. 4 is an expanded view of the removable clutched spline nut and oil lubrication system of this invention.

Lubrication for the jackhammer is provided by introducing a liquid lubricant, preferably oil, into the percussive air. Oil cap 130 threadably closes an oil inlet tube 132 in housing 86, as shown in FIGS. 3 and 4. The operator of the jackhammer introduces oil into inlet 132 at periodic intervals. Piston stem bearing 140 has an internal surface 142 that slidably contacts piston stem 52, and supports piston 46 for reciprocation along axis 44. Piston stem bearing 140 has an external surface 144 that forms an annular recessed portion 146 and a bottom flanged portion 148. Annular recess portion 146, at an upper land surface 150, contacts housing internal wall 152, in a fluid sealing contact. The combination of external surface 144 and housing 152 form an oil chamber 160. Oil chamber 160 can also be formed , in part or in whole, by a recess in an internal surface of housing 152. Oil chamber 160 communicates with inlet tube 132, to carry oil into chamber 160. An oil feed aperture 170 extends through bottom flange 148 and forms an internal recess for a metering element 172, such as a removable, porous, sintered, metallic plug. Oil feed aperture 170 and metering element 172 provide a passageway for oil to enter into the bore of the jackhammer in the area of the removable splined nut 84. Bottom flange 148 also contacts the internal wall of housing 86 in a fluid sealing contact.

Top end 180 of piston stem bearing 140, in a location that is spaced above upper land surface 150, contacts the internal surface 182 of housing 86 in a second fluid sealing contact. Between top end 180 and upper land 150 is a first circumferential groove 184 in external surface 144 that communicates with a second circumferential groove 186 in internal surface 142 of piston stem bearing 140 by way of a plurality of holes 188 spaced circumferentially around piston stem bearing 140. First groove 184 communicates with an external passageway 190 provided for flushing fluid to pass into front piston chamber 192 and out around drill steel 48,100, by way of holes 188 in bearing 140 and grooves 90 in piston stem 52, for flushing debris from the drillhole. The external passageway 190 and grooves 184, 186, plus holes 188 are optional and form no part of this present invention.

In operation, as the return chamber 74 exhausts, a portion of the exhaust enters the front piston chamber 192 in front of piston 46, by way of longitudinal grooves 80 in piston stem 52. There, such exhaust combines with percussive fluid transmitted down through the center of piston 46 from air distributor chamber 56 in the backhead of the jackhammer. The oil and fluid mixture lubricates the wrap spring clutch 96 and other working surfaces in that area, and eventually is exhausted out around the drill steel, to remove debris from the drillhole.

The pressure in this front chamber 192 is usually 10-30 psig, while the pressure in drive chamber 72 and return chamber 74 is much higher, about 90–100 psig. Because oil chamber 160 is positioned below return chamber 74 and not in fluid contact with the pressure therein, oil chamber 160 is only subject to the lower pressure differential caused by the lower pulsing pressure of front piston chamber 160. This lower pressure differential results in less oil being consumed from oil chamber 160.

Having described the invention, what is claimed is:

1. A removable, splined nut for restraining from rotation a reciprocal piston in a housing of a fluid-activated percussive impact tool, said piston having a piston stem with a plurality of longitudinal grooves thereon comprising:

a nut body having an axis, a top end, a bottom end and a center portion therebetween;

an internal surface on said body having at least one longitudinally extending spline thereon, for slidably connecting to a longitudinal groove in said piston stem; and an external surface forming a circumference with at least one male profile lobe thereon, said at least one male profile lobe being formed by a rounded projection extending radially outwardly from said circumference, wherein said external surface is tapered such that, when viewed in a direction perpendicular to the axis of said nut body, said at least one male profile lobe has a center apex portion between said top and bottom ends for interference fit into a housing portion having at least one female profile lobe cavity adapted to receive said at least one male profile lobe.

2. The nut of claim 1 wherein said nut has at least three male profile lobes spaced circumferentially around said nut body.

3. The nut of claim 2 wherein each of said male profile lobes has a longitudinal groove therein for receiving a pin for force fit between said nut body and said housing portion.

4. In a fluid-activated jackhammer having a backhead at a top end, a drill steel chuck at a bottom end, a housing extending therebetween forming a central bore having a reciprocal piston supported therein for reciprocation along a longitudinal axis, and a wrap spring clutch for causing rotation, in one direction, of a drill steel in said chuck during reciprocation of said piston, the improvement comprising:

said piston having a piston stem, a piston tail and a piston head therebetween;

a plurality of longitudinal grooves extending downwardly along said piston stem and spaced apart around a circumference of said piston stem; and a removable nut body having an axis, a splined internal surface slidably connected to said longitudinal grooves, and a male profile lobed external surface restrained in said housing, said external surface forming a circumference with at least one male profile lobe thereon, said at least one male profile lobe being formed by a rounded projection extending radially outwardly from said circumference, wherein said external surface is tapered such that, when viewed in a direction perpendicular to the axis of said nut body, said at least one male profile lobe has a center apex portion between said top and bottom ends for interference fit into a housing portion having at least one female profile lobe cavity, whereby rotation of said nut body and said piston is restrained but longitudinal movement of said piston is permitted.

* * * * *